United States Patent [19]

Hollerbach

[11] Patent Number: 4,907,574

[45] Date of Patent: Mar. 13, 1990

[54] PROM EXERCISE DEVICE FOR OPPOSING CONTRACTURE

[76] Inventor: Thomas R. Hollerbach, 2716 Stevens Ave., South, Minneapolis, Minn. 55408

[21] Appl. No.: 229,335

[22] Filed: Aug. 5, 1988

[51] Int. Cl.[4] ..... A61H 7/00

[52] U.S. Cl. ..... 128/64; 128/44; 128/DIG. 20

[58] Field of Search ..... 128/64, 65, DIG. 20, 128/24 R, DIG. 10, 160, 26, 157, 381, 165, 44

[56] References Cited

U.S. PATENT DOCUMENTS

| | | | |
|---|---|---|---|
| 2,880,721 | 4/1959 | Corcoran | 128/39 |
| 3,242,923 | 3/1966 | Jacoby | 128/DIG. 20 |
| 3,416,518 | 12/1968 | Samuels et al. | 128/165 |
| 3,457,912 | 7/1969 | Clark et al. | 128/26 |
| 3,492,988 | 2/1970 | De Mare | 128/33 |
| 3,547,112 | 12/1970 | Courtney | 128/77 |
| 3,581,740 | 6/1971 | Sherbourne | 128/77 |
| 3,755,820 | 9/1973 | Petrusek | 128/DIG. 20 |
| 3,937,215 | 2/1976 | Barthlome | 128/DIG. 20 |
| 3,990,440 | 11/1976 | Gaylord | 128/165 |
| 4,153,050 | 5/1979 | Bishop | 128/64 |
| 4,274,399 | 6/1981 | Mummert | 128/26 |
| 4,300,759 | 11/1981 | Caplan | 128/DIG. 20 |
| 4,340,042 | 7/1982 | Smith | 128/DIG. 20 |
| 4,596,240 | 6/1986 | Takahashi | 128/26 |
| 4,614,179 | 9/1986 | Gardner | 128/64 |
| 4,619,250 | 10/1986 | Hasegawa | 128/26 |
| 4,671,258 | 6/1987 | Barthlome | 128/26 |

FOREIGN PATENT DOCUMENTS

| | | | |
|---|---|---|---|
| 735700 | 6/1966 | Canada | 128/DIG. 20 |

*Primary Examiner*—Edgar S. Burr
*Assistant Examiner*—Huong Q. Pham

[57] ABSTRACT

A passive range of motion (PROM) device which manipulates hand muscles of patients suffering from contracture. The PROM device includes a glove for receiving the hand of a patient where the glove has an elastic sleeve secured to a palm side of the glove adjacent the points on the glove where fingers join the hand. The elastic sleeve is inflated to stretch and separate the fingers, and is deflated to allow the fingers to contract.

8 Claims, 5 Drawing Sheets

PROM EXERCISE DEVICE FOR OPPOSING CONTRACTURE

BACKGROUND OF THE INVENTION

1. Field of the Invention.

This invention relates to a passive range of motion (PROM) device. More particularly, this invention relates to a glove for preventing and curing contracture of the hand muscles.

2. Description of the Prior Art.

Many diseases and injuries cause temporary or permanent paralysis of the hand. Without constant movement or exercise, the muscles shrink and contract. A very common physical problem affecting people such as stroke victims, people with nerve injury or brain damage, or those who have had a limb immobilized due to illness or injury, is contracture. Contracture results when the nerve supply to a muscle is blocked or cut off. The muscle fibers tend to shorten and can often shorten to the point where the affected part of the body becomes extremely contorted. For example, where the nerve supply to hand muscles is cut off, the hand muscles begin to contract causing the thumb and fingers to coil inward. Later, in full contracture, the hand becomes a tightly clenched fist and the wrist and arm coil inward. Contracture causes poor circulation, pressure sores, and infections.

One way to prevent contracture is to stretch the affected muscles daily. Stretching is achieved through passive exercise which means that the muscle is exercised without any effort on the part of the patient. Passive exercises, or passive range of motion (PROM) exercises must be performed several times daily to prevent contracture. Unfortunately, having PROM exercises administered several times a day requires a great amount of time (approximately one-half hour per session for a quadriplegic). Therefore, a nursing assistant, who is caring for eight or nine patents, for example, may not have a chance to perform it. Additionally, a physical therapist can and should be used to perform the PROM exercises; but, because of the time involved this is very expensive.

Several techniques have been developed to prevent, or slow, the muscle contractions. Many of these involve static stretching in which the affected limb is strapped into a cast or splint in the stretched position. A common method for performing these static stretches is through the use of a wrist-hand orthesis (W.H.O.). However, the effectiveness of the W.H.O. is unclear. Without movement, the muscles continue to contract and, where the affected limb is an arm, the muscles continue to curl the fingers and bend the wrist.

Additionally, the W.H.O. presents several problems. The patient may not get an adequate blood supply because, as the contractions advance, the W.H.O. straps become tighter and tighter. In addition, the W.H.O. is a rigid splint and cannot be adapted to different patients with various degrees of contracture. Another technique which helps prevent contracture is strong electrical stimulation. However, this is very expensive and is generally only used on patients who are expected to recover the use of the affected limb.

Several other techniques are also used which actually move and flex the joints in the affected limb. Many of these use air or fluid pressure to inflate balloons which tend to push or pull the curled limb into a straightened position.

There is a continuing need for passive range of motion devices which offer simple and quick application, which are easy to produce, and which are suitable for use by patients in various states of contracture.

SUMMARY OF THE INVENTION

A passive range of motion (PROM) device which manipulates the hand muscles of a patient suffering from contracture. The PROM device includes a glove for receiving the hand of a patient where the glove has a thumb section and a plurality of finger sections joined to a hand section thereof. An annular elastic sleeve is secured to a palm side of the glove only at a point on each finger adjacent those areas on the fingers of the glove where the fingers join the hand section of the glove. The sleeve is closable at both ends to form a generally tubular enclosure. An inflatable bladder, which is large enough to urge the fingers and thumb of the patient toward a straightened condition when inflated, is inside the tubular enclosure defined by the sleeve. Thus, PROM exercises are administered by inflating and deflating the inflatable bladder.

DETAILED DESCRIPTION OF THE PREFERRED EMBODIMENTS

Figure 1:
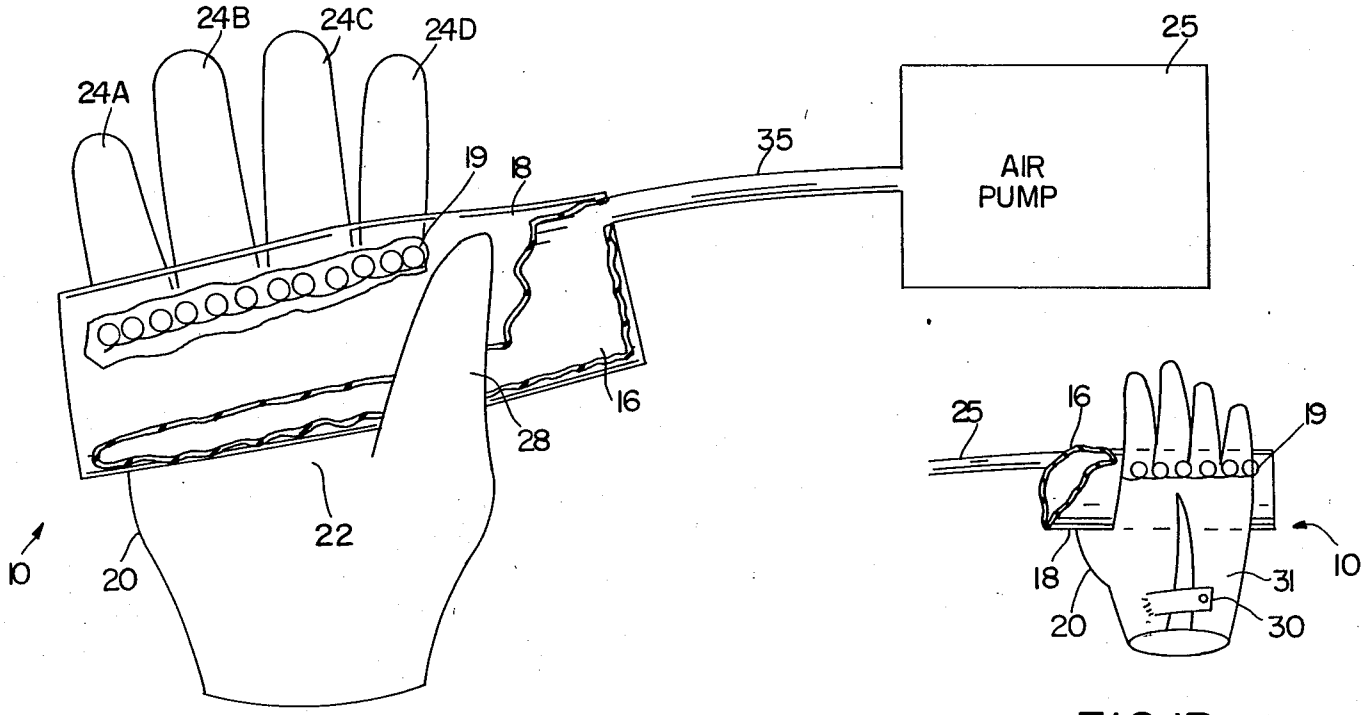
FIG. 1A is a schematic pictoral view of a palm side of the PROM device of the present invention.
FIG. 1B is a pictoral view of the back side of the PROM device.

FIG. 1A shows the passive range of motion (PROM) device 10 of the present invention. The PROM device has an inflatable bladder 16 that is received in and enclosed by an elastic sleeve 18. The elastic sleeve 18 is secured (as at 19) to a glove 20 adjacent a top portion of palm 22 of glove 20 where fingers **24*a*, 24*b*, 24*c*, and 24*d* of glove 20 meet palm 22. Elastic sleeve 18 is secured to the glove 20 so that it extends between fingers 24*a*–24*d* and a thumb 28 of glove 20**.

FIG. 1B shows a rear view of the PROM device 10. Preferably, the glove 20 may have a Velcro latch or a snap 30 (like a golf glove or batting glove) to allow adjustment of the size of the glove 20 to fit various hand sizes.

Figure 2:
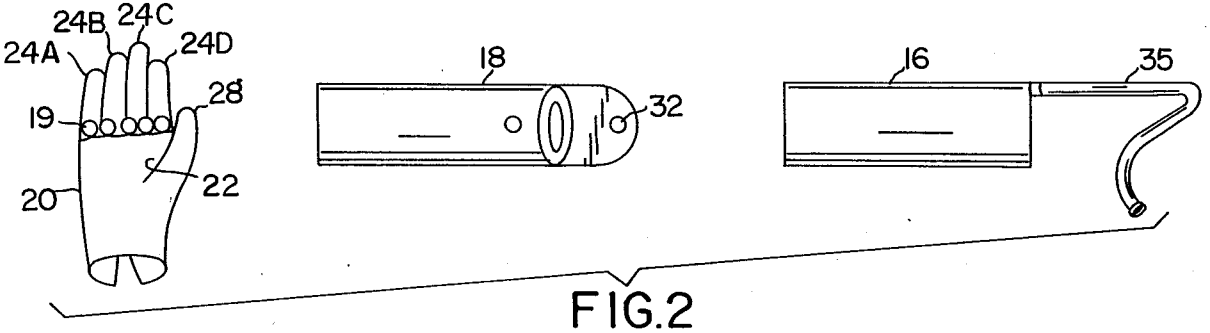
FIG. 2 is an exploded view of the PROM device.

FIG. 2 shows an exploded view of the components of the PROM device 10. The glove 20 is preferably a leather-palmed, web-backed glove. The leather palm 22 of the glove 20 provides a stable base for the elastic sleeve 18. Additionally, the leather palm 22 provides a breathable, sweat-absorbing padding between a patient's skin and the inflatable bladder 16.

The elastic sleeve 18 is preferably tubular in shape and stretches in the radial direction, but not in the axial direction. One end of the sleeve 18 is sealed shut, while the other end is open but has a snap closure 32. Therefore, the snap closure 32 allows the inflatable bladder 16 to be removed from the elastic sleeve 18. Thus, when the glove 20 becomes worn out, the inflatable bladder 16 may be removed and the glove 20 and the elastic sleeve 18, which are relatively low in cost, may be discarded. The elastic sleeve 18 is secured to the glove 20 by suitable means, such as stitching 19. As shown, the sleeve 18 is attached to the glove 20 only at stitching 19 adjacent the base of the fingers **24*a*–24*d*** of the glove, and specifically below the first knuckle area of those fingers of the glove.

The inflatable bladder 16 is similar to a blood pressure cuff. As seen in FIG. 1, the bladder is coupled to a source of air 25 by a suitable conduit 35. The conduit 35 is detachable from the inflatable bladder 16 such that, after the bladder 16 is inflated, the conduit 35 is removable so the patient can wear the inflated bladder 16 and the glove 20 without it being coupled to the air source 25. When the glove 20 becomes worn, the inflatable bladder 16 is removed from the elastic sleeve 18 and placed in a new elastic sleeve 18 which is on a new glove 20. This keeps replacement costs low.

Figure 3C:
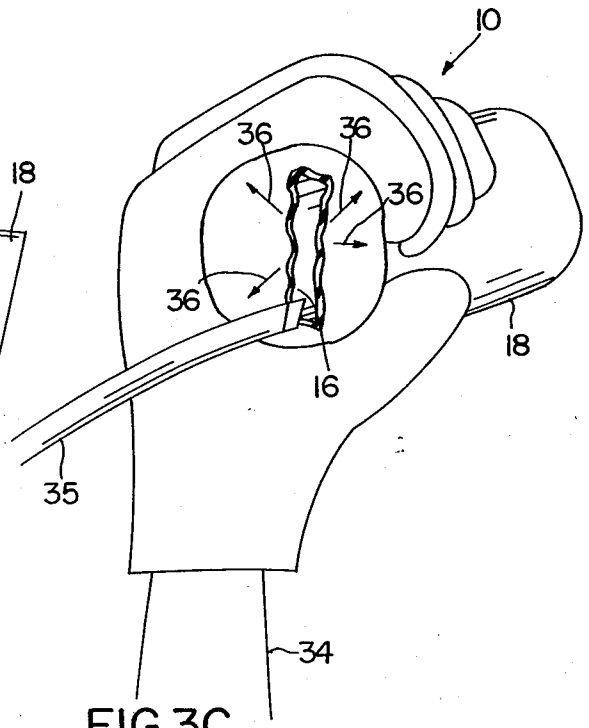
FIGS. 3A–3C show a sequence of inflation of the PROM device of FIGS. 1 and 2.
Figure 3B:
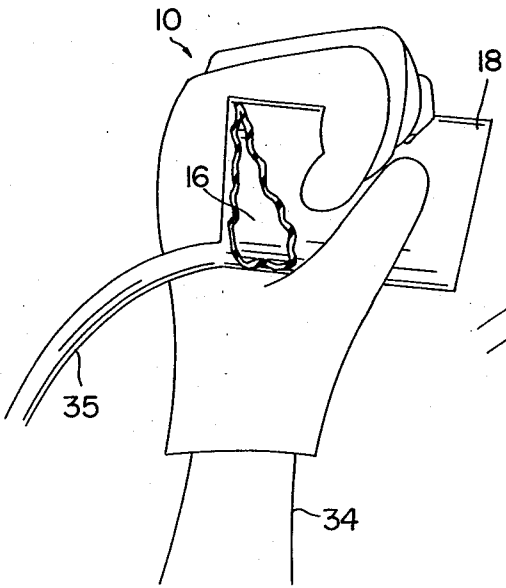
Figure 3A:
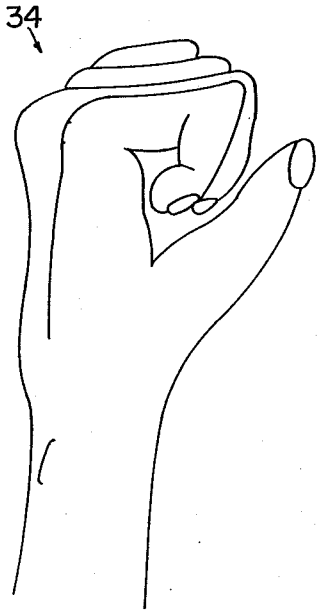

FIG. 3A shows the position of a hand 34 which is suffering from near complete contracture. FIG. 3B shows the affected hand 34 wearing the PROM device 10 of the present invention, with the inflatable bladder 16 not yet inflated. FIG. 3C shows the impaired hand 34 wearing the PROM device 10 of the present invention where the inflatable bladder 16 has been inflated. As the bladder 16 inflates, the sleeve 18 expands radially (the shape of the sleeve, in part, defines the inflated shape of the bladder). Inflation of inflatable bladder 16 thus exerts force on the hand 34 in the direction shown by arrows 36. This force causes the hand to open and the muscles in the affected hand, which are contracted, to stretch. Since the elastic sleeve 18 only stretches radially, and not axially, the elastic sleeve 18, and the inflatable bladder 16, do not become unnecessarily large or bulky in the axial direction.

The key to the effectiveness of the present invention, as seen in FIGS. 1–3, is the placement of the expandable bladder relative to the contracted fingers. Prior to this invention, inflatable hand exercises typically exerted primary force (either pushing or pulling) adjacent the outer ends of a patient's fingers or on general areas on the hand, rather than specifically at the location adjacent the first knuckle of the fingers. The present invention, on the other hand, operates in the first instance on those muscles adjacent the first knuckle and palm of a patient's contracted hand. This is accomplished by the careful location of the bladder relative to the glove, namely the stitching of the tubular sleeve for the elongated bladder only to the glove at those points adjacent the base of the fingers of the glove, but not quite on the palm area of the glove. Because of this unique location of the bladder relative to the contracted hand, expansion of the bladder will cause the hand and muscles therein to expand more naturally, working through the base of the fingers outwardly knuckle by knuckle, rather than pulling on areas adjacent the ends of the fingers or expanding a bladder generally against the hand to push or pull it toward a flattened position.

Figures 4, 5A, 5B, 6A, 6B:
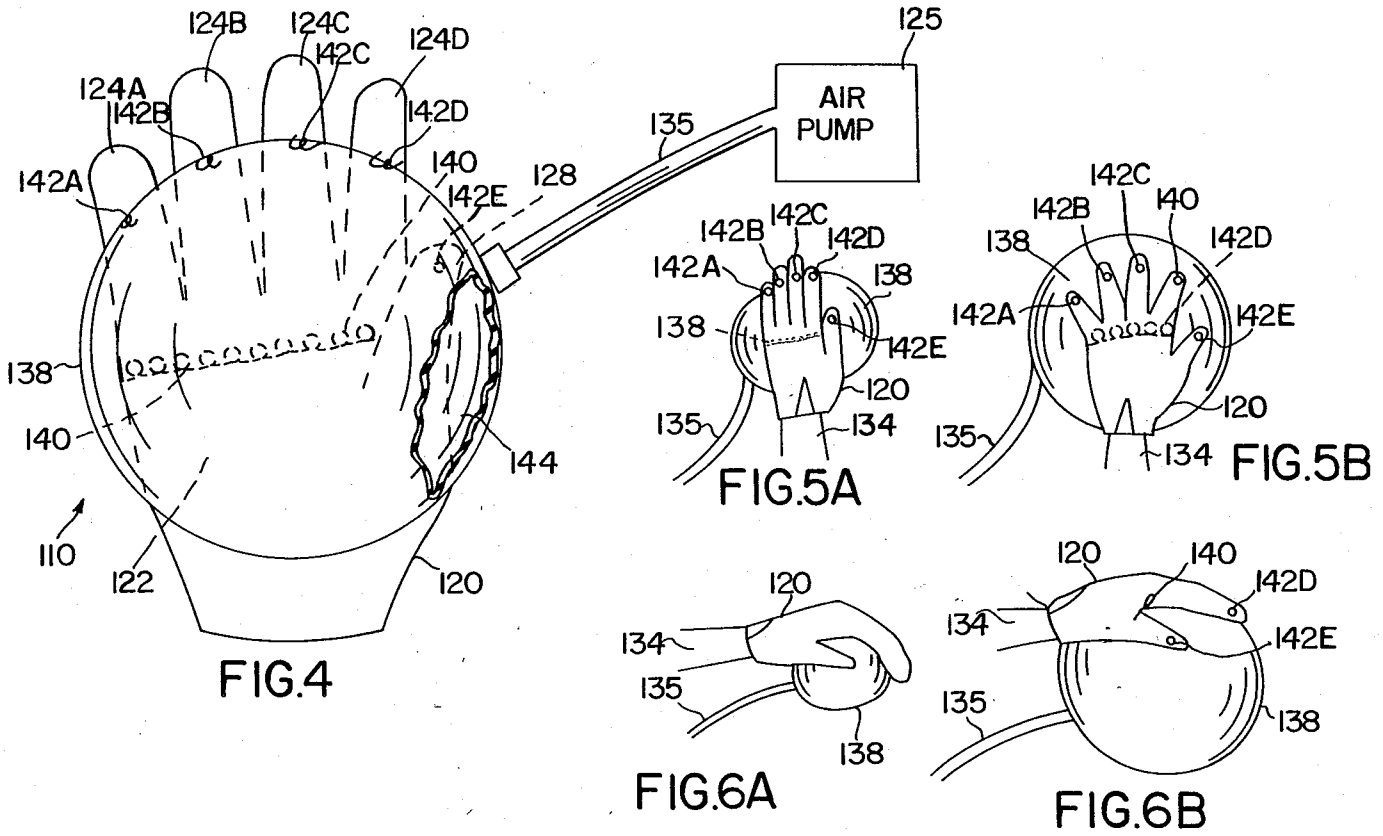
FIG. 4 shows a second embodiment of the PROM device of the present invention.
FIGS. 5A and 5B show a sequence of inflation of the PROM device of FIG. 4 (back view).
FIGS. 6A and 6B show a sequence of inflation of the PROM device of FIG. 4 (side view).

FIG. 4 shows a second embodiment of the PROM device of the present invention. This embodiment of the present invention is designed for persons who have not yet suffered contracture, but who are unable to control the use of the muscles in their hands. For example, an accident-induced paralysis victim, immediately after the accident, still may have a full range of mobility in his or her hand. Over time, however, contracture will set in and the hand will become deformed into the position generally shown in FIG. 3A. In order to prevent such an occurrence, the PROM device 110 seen in FIG. 4 is employed. FIG. 4 shows the glove 120 attached to a spherical elastic sleeve 138 at stitching 140, which is on the palm 122 of the glove 120 adjacent and spaced from the fingers of the glove. The spherical elastic sleeve 38 is also attached to each finger 124A, 124B, 124C and 124D and the thumb 128 of the glove 120 at stitching points 142A, 142B, 142C, 142D, and 142E (on the palm-side proximate the tip of each finger and the tip of the thumb). A spherical inflatable bladder 144 is located within spherical elastic sleeve 138. The sleeve 138 has a closure arrangement which allows replacement of the bladder 144 if desired. The bladder is selectively secured to an air source 125 by a conduit 135.

FIGS. 5A and 6A show the PROM device 110 worn by an affected hand 134 where the spherical inflatable bladder 144, located within spherical elastic sleeve 138, is deflated.

FIGS. 5B and 6B show the PROM device of the second embodiment which is where the inflatable bladder 144 has been inflated. As spherical inflatable bladder 144 is inflated, the surface area of spherical elastic sleeve 138 expands radially in all directions. Since the fingers 124A–124D, and thumb 128, of glove 120 are at secured stitching points 142A–142E to the spherical elastic 138, as the spherical bladder 144 inflates, the fingers of the affected hand 134 are extended and spread apart from one another. Therefore, the affected muscles in the affected hand 134 are stretched.

The fingers of the affected limb 134 are not only spread when the inflatable bladder 144 is inflated (as seen in FIG. 5B), but they are also extended. FIG. 6B shows the extension of the fingers of the affected hand 134 that is achieved when spherical inflatable bladder 144 is inflated.

The second embodiment shown in FIGS. 4–6 not only works to work the muscles when the hand is open and spread apart, but also to work those muscles of the hand for clenching. The spherical elastic sleeve 138 contracts about the bladder when the bladder is deflated and thus pulls the fingers and thumb inwardly toward the palm of the hand as bladder deflation occurs. This is accomplished because the fingers and thumb of the glove 120 are stitched to the spherical elastic sleeve 138 at 142A, 142B, 142C, 142D and 142E. Thus, the embodiment of the present invention seen in FIGS. 4–6, is quite effective in opening and closing a patient's hand. The sleeve has a closure (not shown) which allows removal of the bladder.

Figure 7:
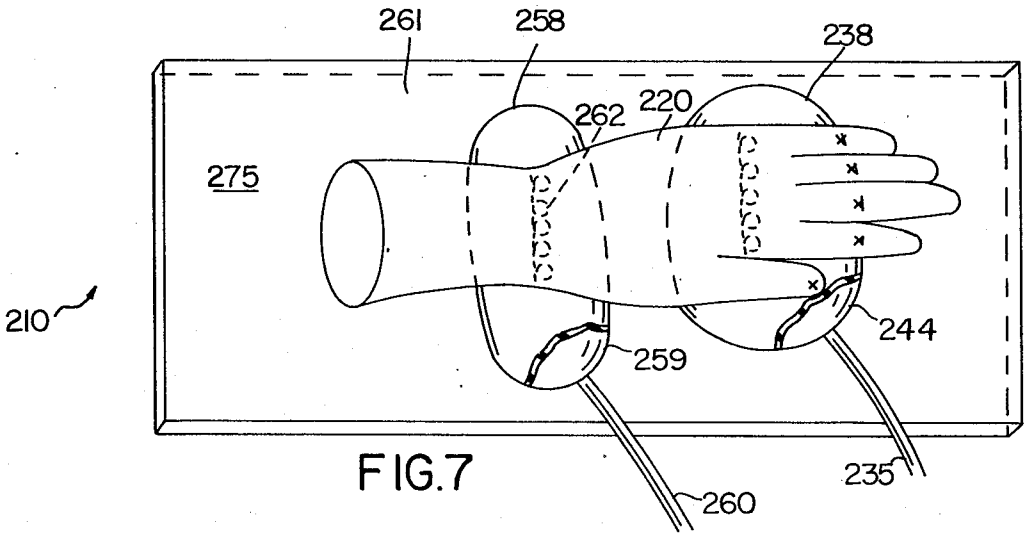
FIG. 7 shows a perspective view of a third embodiment of PROM device of the present invention.

FIGS. 7 and 8 show a third embodiment of the PROM device of the present invention. FIG. 7 shows a glove 220 secured with respect to a base member 275 by a pair of elastic sleeves 238 and 258. Sleeve 238 is formed and attached to the glove 220 in the same manner as the third embodiment just described above (sleeve 138 with respect to glove 120). Sleeve 238 thus includes a round inflatable bladder 244, coupled to an air source by a conduit 235. The sleeve 258 includes an inflatable bladder 259, also coupled to an air source by a suitable conduit, such as conduit 260. Glove 220 has an arm extension or arm section 261 which is designed to extend over and past the wrist of a patient. The sleeve 258 is attached to the glove 220 across that area (on the palm side of the glove), where the arm section 261 extends from what would have been the end of the glove 220 (essentially, the wrist area) at stitching 262.

The elastic sleeves 238 and 258 are also secured to a base member 275. Thus, as seen in FIG. 8A, the sleeves 238 and 258 are attached adjacent their top sides to the glove 220. On bottom sides thereof, the sleeves 238 and 258 are secured to the base member 275 as at 276 and 277, respectively.

Figure 8B:
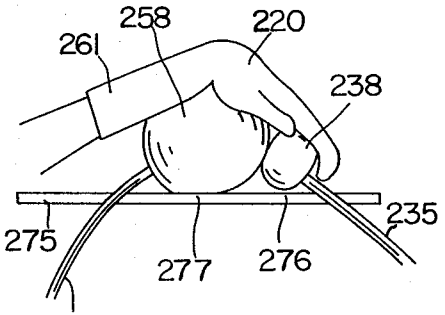
FIGS. 8A, 8B and 8C show a sequence of inflation of the PROM device of FIG. 7 (side view).
Figure 8C:
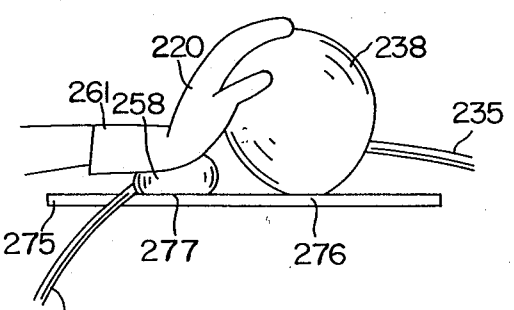
Figure 8A:
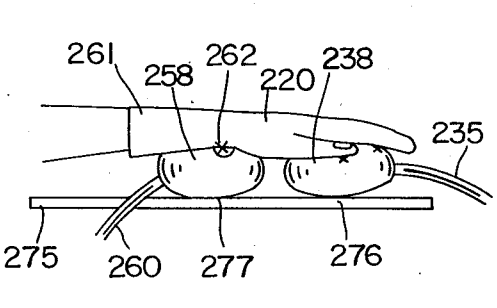

As seen in FIGS. 8B and 8C, the PROM device 210 of the third embodiment is designed to not only exercise the muscles of the hand, but also the muscles adjacent the wrist and those of a patient's arm. The bladders 244 and 259 in the sleeves 238 and 258, respective, are inflated alternatively to rock the patient's hand and the glove 220 back and forth relative to the base member 275. Of course, as the sleeve 238 expands and contracts, it also pushes the patient's fingers outwardly and apart (during inflation), and pulls them inwardly (during deflation). The sleeve 258 expands as its bladder 259 is inflated, and contracts to pull the glove 220 downwardly toward the base member 275 when the bladder 259 therein deflates. The PROM device 210 thus operates to exercise the muscles in the patient's fingers, hand, wrist and arm. Again, the sleeves of this embodiment have closures to permit removal of their respective bladders.

Figure 9:
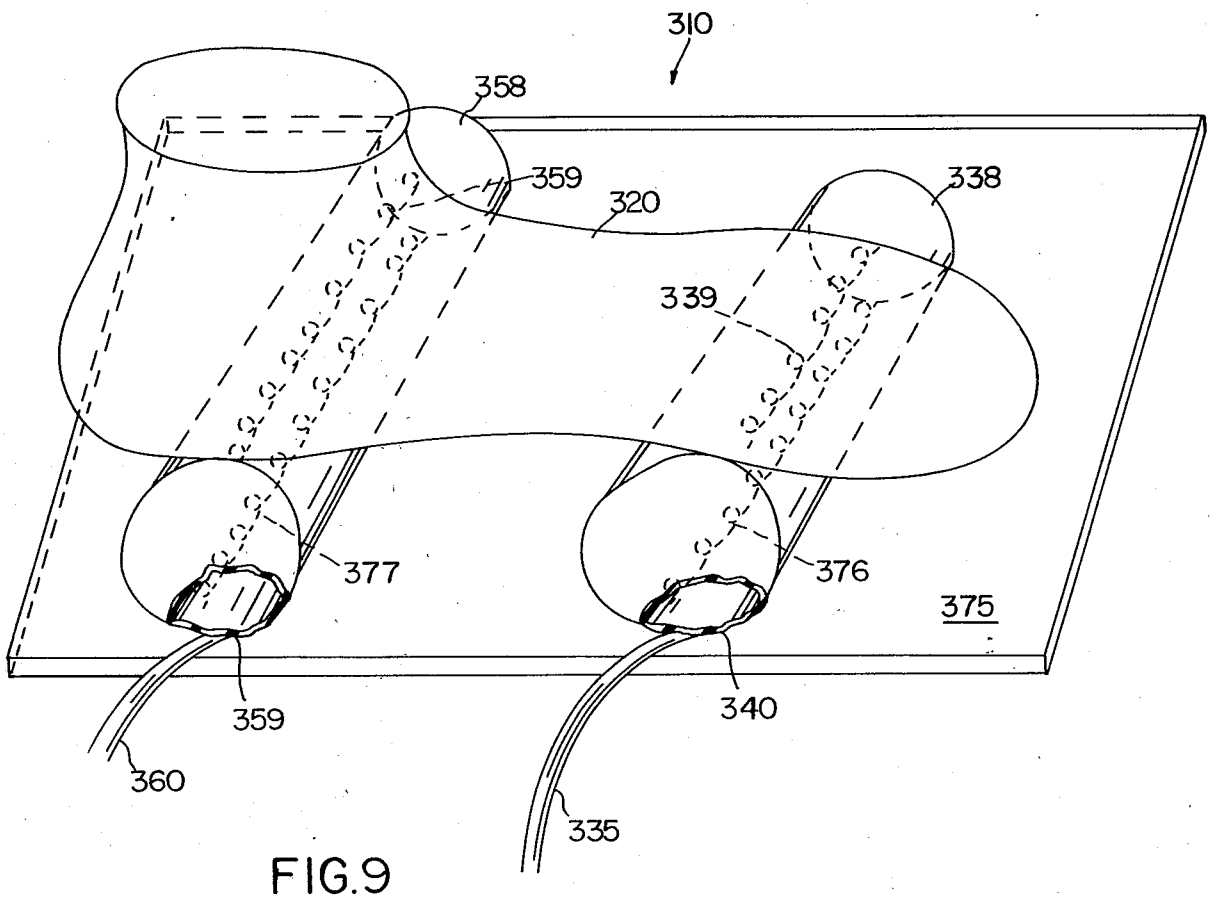
FIG. 9 shows a perspective view of a fourth embodiment of the PROM device of the present invention.

FIG. 9 shows a fourth embodiment of the PROM device of the present invention. This version of the PROM device, indicated generally as PROM device 310, is for exercising the foot, ankle and leg muscles of a patient. A stocking 320 is designed to receive the foot of a patient. A first sleeve 338 is secured, on one side thereof, to the bottom side of the stocking 320 adjacent a ball area thereof by stitching 339. As seen, the sleeve 338 is generally cylindrical and an inflatable bladder 340 removably retained therein. The bladder is connected to an air source by a suitable conduit 335. The elastic sleeve and bladder design is similar to that of the first embodiment, wherein inflation of the bladder expands the bladder and sleeve radially outwardly.

A second elastic sleeve 358 is also secured on its top side to a bottom side of the stocking 320. The second sleeve 358 is secured adjacent to the heel area of the stocking by stitching as at 359. The second sleeve 358 is shaped similarly to the first sleeve 338, and also removably includes an inflatable bladder 359 of similar shape to bladder 340. The bladder 359 is in turn, connected to an air source by a suitable conduit 360.

A base member 375 is provided, similar in function to the base member 275 of the third embodiment. The elastic sleeves 338 and 358 are secured to the base member 375, as at areas 376 and 377, respectively. In use, the inflatable bladders 340 and 359 are inflated and deflated alternatively to rock the foot of a patient within the sleeve 320 with respect to the base member 375, thereby exercising the patient's foot, ankle and leg muscles.

Although not shown with respect to any of the embodiments disclosed above, suitable air pressure control means for the bladders are provided and are well known. Such air control arrangements may include valving suitable to alternate the air pressure between the bladders of the third and fourth embodiments to alternatively inflate and deflate them. Additionally, such air control arrangements would pressurize and depressurize the inflatable bladders of the first and second embodiments, to provide a suitable exercise for an impaired patient. In addition, such control arrangements can operate to progressively inflated (larger and larger) the bladder of the first embodiment, for example, as a patient's hand is exercised, to gradually stretch and work the muscles of the patient from their most contracted state to a more natural state.

The present invention is a simple and quick technique for applying passive range of motion stretching exercises to a limb which is suffering from contracture. With respect to the first embodiment, the necessary stretching can be achieved by simply putting on the glove 20 and inflating the inflatable bladder 16. Since the degree of inflation of the inflatable bladder is controllable by using an air pump, the device of the present invention is adaptable to patients with different degrees of contracture. Additionally, since the pressure which is exerted on the affected limb is exerted on the inside surface of the hand, namely the palm, and since the palm is generally the toughest skin on the hand, the possibility of pressure sores is substantially eliminated.

Although the present invention has been described with reference to preferred embodiments, workers skilled in the art will recognize that changes may be made in form and detail without departing from the spirit and scope of the invention. For example, although the elastic sleeve of the present invention may change shape, a single inflatable bladder, made of a material which will inflate to the same shape as the sleeve in which it is contained, could be used for all shapes of elastic sleeves. Additionally, the sleeve may be eliminated altogether, with the bladder being secured directly to the glove (or stocking) and base member, and the bladder being elastic and having a shape memory so that when deflated, it always contracts to the same shape.

What is claimed is:

1. A passive range of motion (PROM) device for manipulating hand muscles of a patient suffering from contracture, the PROM device comprising:

a glove for receiving the hand of a patient, with the glove having a thumb section and a plurality of finger sections joined to a hand section thereof;

an elastic sleeve secured to a palm side of the glove only at a point on each finger adjacent those areas on the fingers of the glove where the fingers join the hand section of the glove, and means to selectively close the sleeve to form a generally tubular enclosure; and an inflatable bladder in the tubular enclosure defined by the sleeve, with the bladder being of a size sufficient to urge the fingers and thumb of the patient toward a straightened condition when inflated.

2. A passive range of motion (PROM) device for manipulating hand muscles of a patient comprising:

a glove for receiving the hand of a patient, with the glove having a thumb section and a plurality of finger sections joined to a hand section;

an elastic sleeve secured to a palm side of the hand section of the glove adjacent yet spaced from those points where the fingers of the glove join the hand section of the glove and to a palm side of the finger and thumb sections of the glove at a point proximate the tip of each finger and thumb section of the glove, and means to selectively close the sleeve to define a ball-shaped enclosure therein; and a spherically-shaped inflatable bladder in the ball-shaped enclosure defined by the sleeve, the bladder being of a size sufficient to urge the fingers and thumb of the patient toward a straightened condition when inflated, with the elastic sleeve having an elasticity and non-stretched shape sufficient to pull the fingers and thumb of the patient toward a fist-like condition when the bladder is deflated.

3. The PROM device of claim 1 wherein one end of the sleeve is permanently sealed and the other end thereof is selectably closeable for replacement of the bladder therein.

4. The PROM device of claim 1 wherein the bladder is prolate shaped when inflated.

5. A passive range of motion (PROM) device for manipulating finger, hand, wrist and arm muscles of a patient comprising:

a glove for receiving the hand of a patient, the glove having a thumb section and a plurality of finger sections joined to a hand section, and an arm section joined to the hand section for covering at least the wrist of a patient when worn;

a first inflatable bladder secured, on a top side thereof, to a palm side of the hand section of glove adjacent yet spaced from those points where the fingers of the glove join the hand section of the glove and to a palm side of the finger and thumb sections of the glove at a point proximate the tip of each finger and thumb section of the glove;

a second inflatable bladder secured, on a top side thereof, with respect to a palm side of the glove at those points where the hand section of the glove joins the arm section of the glove; and a bladder mounting base, each bladder mounted, on a bottom side thereof, with respect to the base whereby alternating inflation of the first and second bladders urges portions of the patient's fingers, hand, wrist and arm toward and away from the base to flex the muscles in the fingers, hand, wrist and arm.

6. The PROM device of claim 5, and further comprising:

an elastic sleeve surrounding each bladder.

7. A passive range of motion (PROM) device for manipulating foot, ankle and leg muscles of a patient comprising:

a stocking for receiving the foot of a patient having, on a bottom side thereof, a ball area and a heel area;

a first inflatable bladder secured, on a top side thereof, to the bottom side of the stocking at its ball area;

a second inflatable bladder secured, on a top side thereof, to the bottom side of the stocking at its heel area; and a bladder mounting base, each bladder mounted, on a bottom side thereof with respect to the base whereby alternating inflation of the first and second bladders urges portions of the patient's foot, ankle and leg toward and away from the base to flex the muscles in the foot ankle and leg.

8. The PROM device of claim 7, and further comprising:

an elastic sleeve surrounding each bladder.

* * * * *